US005655558A

United States Patent [19]

Child

[11] Patent Number: 5,655,558

[45] Date of Patent: Aug. 12, 1997

[54] MULTIPLE CONFIGURATION TENT STRUCTURE

[76] Inventor: David L. Child, 507 Washington Ave., Phoenixville, Pa. 19460

[21] Appl. No.: 470,126

[22] Filed: Jun. 6, 1995

[51] Int. Cl.[6] ..... E04H 15/30

[52] U.S. Cl. ..... 135/97; 52/81.1; 52/81.3; 135/100; 135/147; 135/120.3

[58] Field of Search ..... 52/81.1, 81.2, 52/81.3, 63; 135/87, 97, 100, 147, 159, 120.3, 127, 156

[56] References Cited

U.S. PATENT DOCUMENTS

| | | | |
|---|---|---|---|
| 1,413,529 | 4/1922 | Hansen | 135/159 |
| 1,546,222 | 7/1925 | Finlay | 135/159 X |
| 2,719,384 | 10/1955 | Eames | 135/100 |
| 3,174,493 | 3/1965 | Gruenberg | 135/120.3 X |
| 3,376,879 | 4/1968 | Huddle | 135/97 |
| 3,620,235 | 11/1971 | Du Plessis . | |
| 3,699,986 | 10/1972 | Kirkham | 135/97 |
| 3,874,396 | 4/1975 | Kirkham | 135/97 |
| 4,308,698 | 1/1982 | Fleishman | 52/81.3 |
| 4,309,852 | 1/1982 | Stolpin | 52/81.3 |
| 4,311,159 | 1/1982 | Wunderlich . | |
| 4,590,956 | 5/1986 | Griesenbeck | 135/127 X |
| 4,882,884 | 11/1989 | Browne | 135/97 X |
| 4,998,552 | 3/1991 | Niksic et al. . | |
| 5,343,887 | 9/1994 | Danaher . | |
| 5,347,667 | 9/1994 | Schwarz et al. . | |
| 5,360,028 | 11/1994 | Jasin . | |
| 5,361,794 | 11/1994 | Brady . | |
| 5,390,689 | 2/1995 | Graillat . | |
| 5,394,897 | 3/1995 | Ritchey et al. . | |

*Primary Examiner*—Wynn E. Wood
*Attorney, Agent, or Firm*—Kevin W. Goldstein

[57] ABSTRACT

A tent structure capable of being configured into a variety of distinct shapes for different recreational purposes is disclosed. The tent structure may be comprised of a plurality of stringers pivotally interconnected to form geometric subsegments and a shaped skin attachable to the stringers, or may be constructed from a plurality of geometric-shaped plates flexibly interconnected to each other.

24 Claims, 19 Drawing Sheets

MULTIPLE CONFIGURATION TENT STRUCTURE

FIELD OF THE INVENTION

This invention relates to tent-like structures, and more particularly to portable structures capable of being configured for use as a tent, sunshade, wind-block and dressing room structure.

BACKGROUND OF THE INVENTION

Individuals who enjoy spending time at the beach use tents, sunshades and windblock structures as part of their recreational activity. Various features of these devices that the public desire include portability, collapsibility, durability and general attractive appearance. One critical feature required of any tent structure to enjoy acceptance and use by the public is that the device be easy to set up in a minimal amount of time.

The prior art provides many examples of various tent-like structures. Several examples within the prior art disclose certain features or improvements including collapsible and portable structures. However, the prior art suffers from one or more disadvantages, including, in general terms difficulty in setting the structures up for use. Moreover, the prior art tent structures provide but one configuration when assembled. That is, these devices provide one configuration for use, thereby limiting the overall recreational utility of the device.

One example of a foldable tent frame is disclosed in Brady, U.S. Pat. No. 5,361,794, *Unitized Foldable Tent Frame*. Brady patent describes a unitized foldable tent framework comprised of a series of elongated members pivotally connected to form a roof section and a wall or perimeter section. While the Brady structure is designed to be foldable and incorporates an elastic perimeter element to accommodate increased overall dimensions, the assembled structure is limited to but one configuration.

Similar in design to Brady is Niksic et al., U.S. Pat. No. 4,998,552, *Geodetic Tent Structure*. The Niksic patent teaches a self-supporting and collapsible dome-shaped tent structure comprised of a plurality of light-weight structural rods assembled with connecting hubs. As described within the Niksic patent, the free-standing tent structure requires the use of a structurally cooperative floor section capable of bearing tension from the domed tent structure members. The Niksic structure, while being collapsible and allegedly portable, is, upon being assembled, limited to one structural configuration.

Both the Brady and Niksic devices disclose the use of complex hub mechanisms to interconnect the structural frame members. The use of these hub mechanisms appear to require extensive set up time because each hub must be appropriately twisted or rotated to lock the structural members into a rigid configuration.

Another example of a portable tent structure is the Jasin, U.S. Pat. No. 5,360,028, self-erecting tent on folding case. Within Jasin, a tent-like structure is disclosed having a top and bottom surface that is shaped about a symmetrical center folding line such that, upon unfolding the structure, results in the opening of a substantially concave shell section capable of accommodating a sleeping bag. While the Jasin device appears to be relatively easy to set up, it, like the other prior art devices, is restricted to one configuration when assembled or opened, thereby limiting its recreational utility.

It is clear that none of the prior art discloses a device capable of being easily and quickly set up, that is also easily configured into a portable tent, sunshade, windblock and a dressing room. In light of the disadvantages and structural deficiencies in the prior art, an objective of the present invention is to provide a tent-like structure capable of being configured into different structures for use as a tent, sunshade, windblock or other related type of recreational devices. In addition, a related objective of the present invention is that the device be easily assembled, readily collapsible and portable.

The above-noted problems and deficiencies exhibited by the prior art are each addressed and resolved by the present invention, and accordingly provides a significant improvement over the prior art relating to tent structures.

SUMMARY OF THE INVENTION

The limitations and problems exhibited by the prior art are addressed and resolved by the present tent structure invention.

In one preferred embodiment, the present invention is a multiple and variable configuration tent structure that is portable, collapsible, lightweight, durable and easily and quickly assembled and disassembled. The multiple configuration tent structure may be comprised of a frame structure and a shaped skin.

One preferred stringer embodiment is constructed with nine stringers pivotally interconnected to form four common sided triangular subsegments defining an overall triangular shape. Another preferred stringer embodiment is constructed with six stringers pivotally interconnected to form two common sided triangular subsegments and a separate support stringer element.

The shaped skin may, in one preferred embodiment, cover the entire tent frame structure, or in another preferred embodiment, cover less than all of the frame structure.

In another preferred embodiment, the stringer and shaped skin configuration may be replaced with geometric plates that are pivotally interconnected.

The pivotal interconnection means for the stringers and the prates may be constructed from many different materials. In one preferred embodiment, rubberized tubing is used to interconnect the stringers. Another preferred embodiment uses string or cord embedded into the stringer ends. A further preferred embodiment for the stringer interconnections uses springs or elastic material.

In these preferred embodiments, a multiple configuration tent structure is provided that may be used for many recreational purposes, including, but not limited to a sunshade, windblock, tent and dressing room. The present invention resolves the deficiencies and problems shown by the prior art. The invention will be best understood by studying the following detailed description of preferred embodiments in conjunction with attached drawings.

BRIEF DESCRIPTION OF THE DRAWINGS

For the purpose of illustrating the invention, there are shown in the attached drawings, forms of the invention which are presently preferred. It should however be understood that the invention is not limited to the precise arrangement and instrumentality shown.

DETAILED DESCRIPTION OF THE INVENTION

The present invention is a multiple and variable configuration tent structure that in preferred embodiments may be advantageously used at the beach or lake front, for camping, for hiking and many other recreational activities. In addition to the multiple configuration feature, the invention is portable, collapsible, lightweight, durable, and is also easily and quickly assembled or disassembled by one person. The tent structure offers significant advantages and improvement it over the prior art. While the attached drawings show a series of preferred embodiments of the present invention, the drawings are not to be construed as limiting in any manner the scope of the attached claims which define the actual breadth of the invention.

Figure 1:
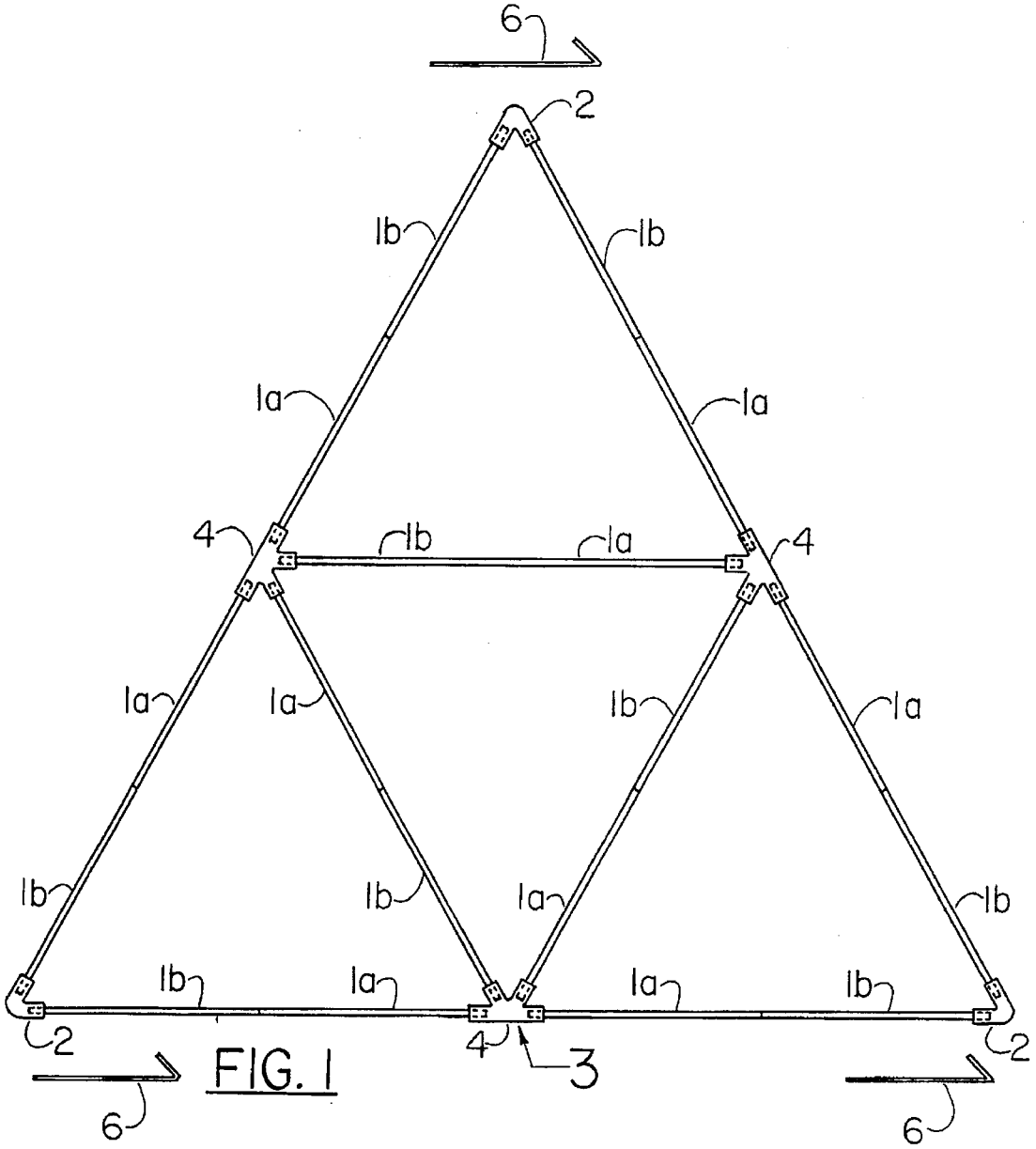
FIG. 1: is a top view of a preferred embodiment of the invention stringers fully assembled without the shaped skin.

In a preferred embodiment the multiple configuration tent structure 8 comprises a frame structure and a shaped skin. The frame structure may in a preferred embodiment be assembled from stringer elements 1 that are pivotally interconnected to form a series of interconnected geometric subsegments. As shown in FIG. 1, a preferred nine stringer embodiment may form four common sided triangular subsegments defining an overall triangular shape 3. Details regarding preferred aspects and embodiments of the pivotal interconnections 2 and 4 are described below.

Figure 3:
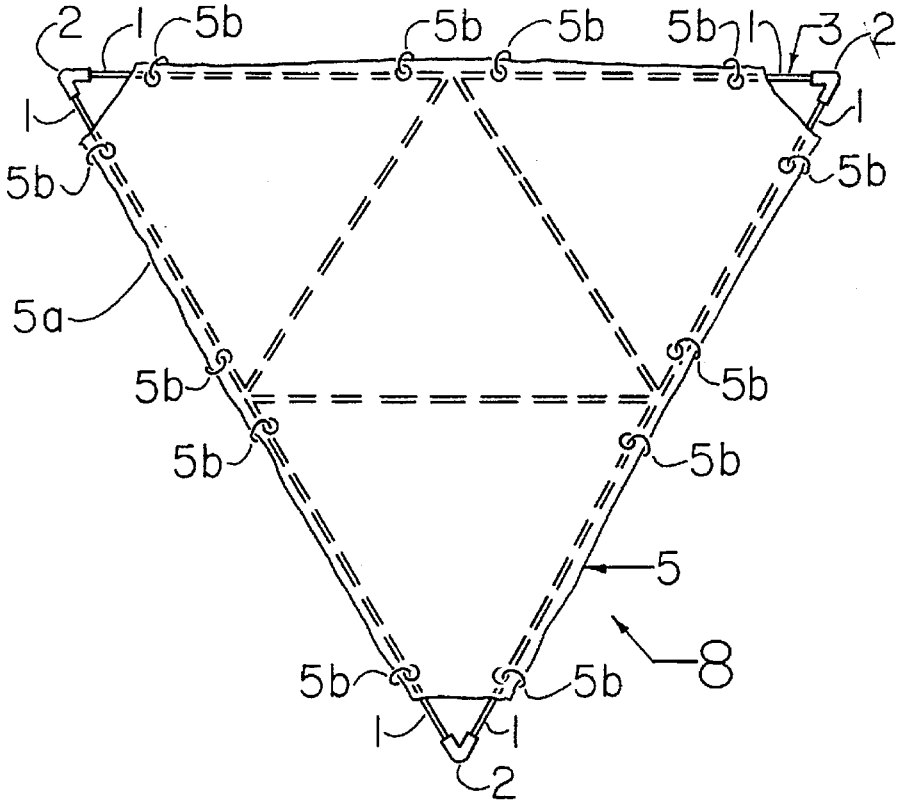
FIG. 3: is a top view of a preferred embodiment of the invention stringers fully assembled with a full shaped skin attached to the stringers.

Attached to the assembled frame structure 3 is a skin material 5 which may be shaped to fit the frame geometry as shown in FIG. 3. However, the skin may also be shaped to cover less than all of the subsegments and thereby increase the openness and views available from the tent structure. This embodiment could be used for example as a sunshade at the beach.

The overall size of the tent structure is not restricted by any physical requirements. As used for recreation at the beach or for hiking or other activities, stringers 1 of six foot length would result in the nine stringer embodiment being a triangular shape of approximately twelve foot sides. This has been found to be a stable and portable configuration. However, there is no particular restriction to reducing or increasing the overall size of the tent configuration.

Various methods of attaching the shaped skin to the frame stringers are available. Preferred methods include snaps, Velcro® tape, string or cord, adhesive tape, ringlets **5*b*** extending through grommets that are embedded in the skin material and encircling the stringers, or any combination of these methods. Furthermore, a preferred embodiment for the present invention is with the shaped skin formed integrally with the stringers. In this embodiment, the user need not assemble or attach the skin to the tent structure. The skin is already part of the configuration.

While the shaped skin 5 may be fabricated of a durable material for use as a tent cover, sunblock or windblock, it likewise may be made of a netting or thin textile to allow air to flow through the device unrestricted. Additionally, the use of this type of shaped skin material would prevent the entry of insects and other outdoor pests.

Figure 2:
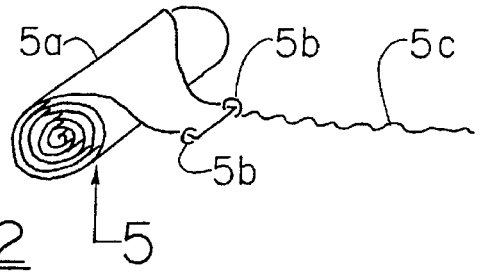
FIG. 2: is a side perspective view of the shaped skin rolled up prior to attaching it to the stringer elements.

As part of the enhanced portability of the present invention, in a preferred aspect, the skin is readily foldable or flexible and may be rolled into a compact configuration after the tent structure is disassembled as shown in FIG. 2. In another preferred embodiment, the disassembled stringers may be bundled within the rolled up skin.

Figure 4:
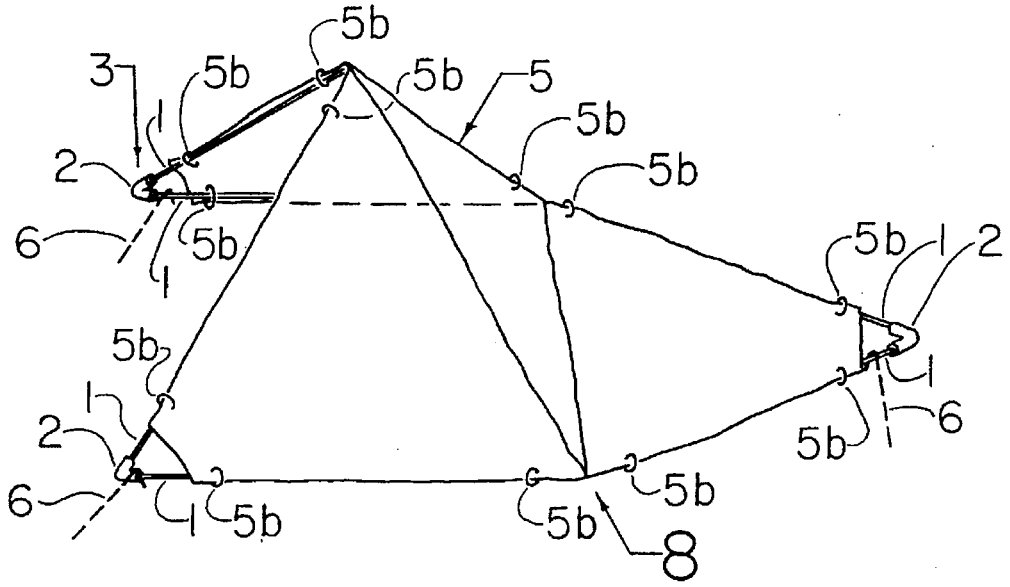
FIG. 4: is a side perspective view of a preferred embodiment of the invention in a "pyramid" configuration.
Figure 5:
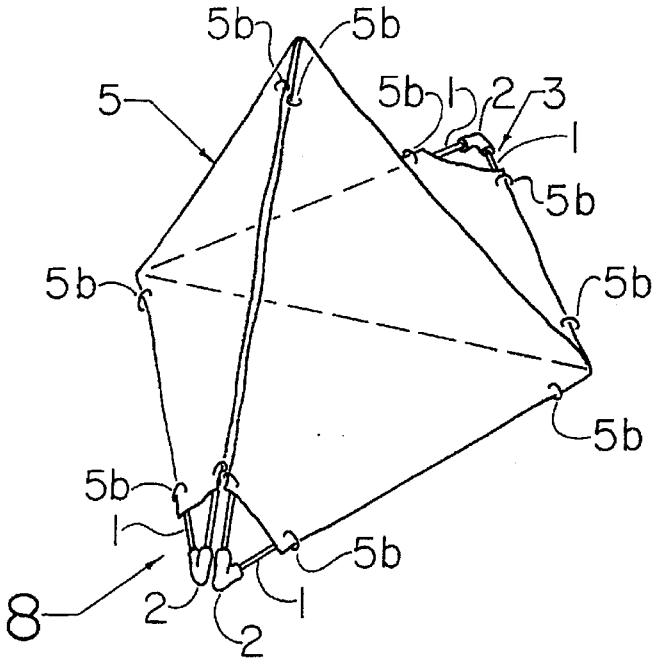
FIG. 5: is a side perspective view of a preferred embodiment of the invention in a "dressing room" configuration.

Upon complete assembly, a primary feature of the multiple configuration tent structure 8 is recognizable. Because of the flexible interconnection of the stringer elements, and accordingly the flexible interconnection between the geometric subsegments, the tent structure 8 may be easily configured into a variety of different and unique configurations for different recreational purposes. As shown in FIG. 4, a simple pyramid shape is achieved by laying one of the triangular subsegments flat. In this configuration, the tent structure 8 may be used as a windblock, sun shade or open-ended tent. By simply bringing the two sides of the pyramid structure together, as shown in FIG. 5, a dressing room configuration is achieved.

Figure 6:
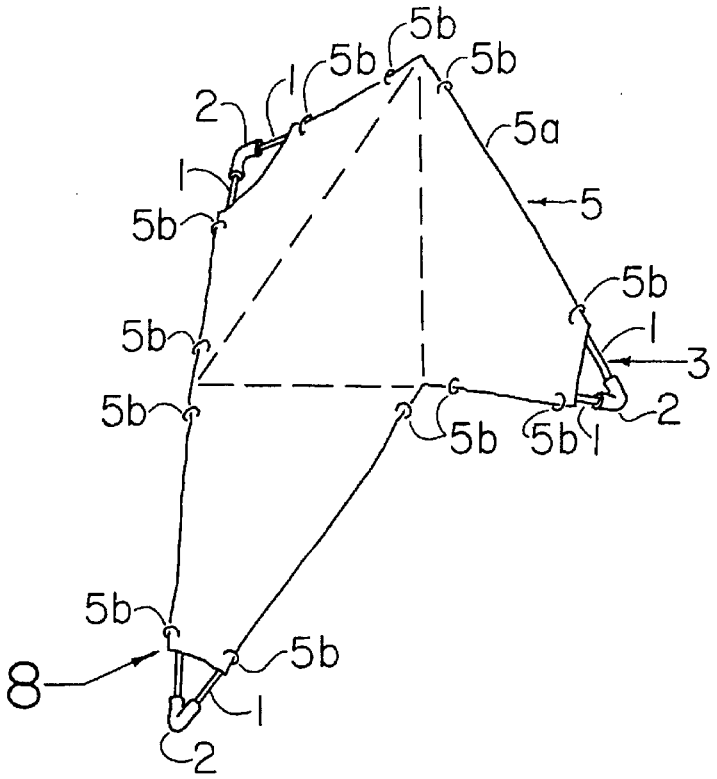
FIG. 6: is a side perspective view of a preferred embodiment of the invention in a "windblock" configuration.
Figure 7:
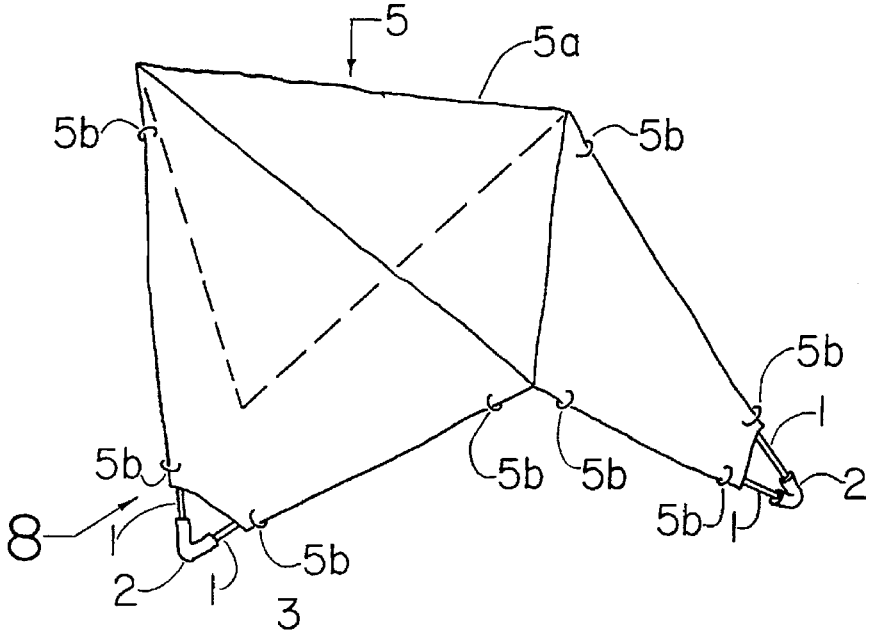
FIG. 7: is a side perspective view of a preferred embodiment of the invention in a miscellaneous configuration.

A simple reshaping of the structure provides a larger style windblock configuration. The FIG. 6 "windblock" is configured by aligning three of the four triangular subsegments against the wind, essentially forming a wall, and tilting the fourth triangle over as a support leg. In this configuration, the user has a large and stable windblock with the advantage of a wide open view out of the tent in direction opposite the "wall."

By standing the nine stringer embodiment on its three corners, variations of a sunshade or tent structure 8 are quickly configured. FIG. 7 through FIG. 11 show variations on this configuration illustrating the use of the multiple configuration tent 8 as a narrow-based or wide-based sunshade. In this configuration, the tent is easily modified to shield the user from the sun as it rises or sets throughout the day. Similarly, this general configuration may be a adjusted to provide a shield from prevailing winds. Indeed, in any of the positions, the tent is useful as a shield from the elements.

Figure 8:
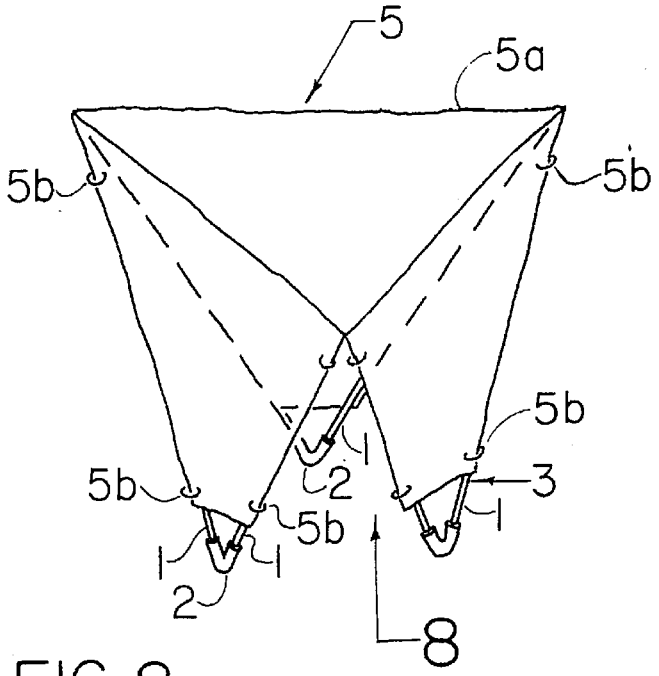
FIG. 8: is a side perspective view of a preferred embodiment of the invention in a narrow-based "sunshade" configuration.
Figure 9:
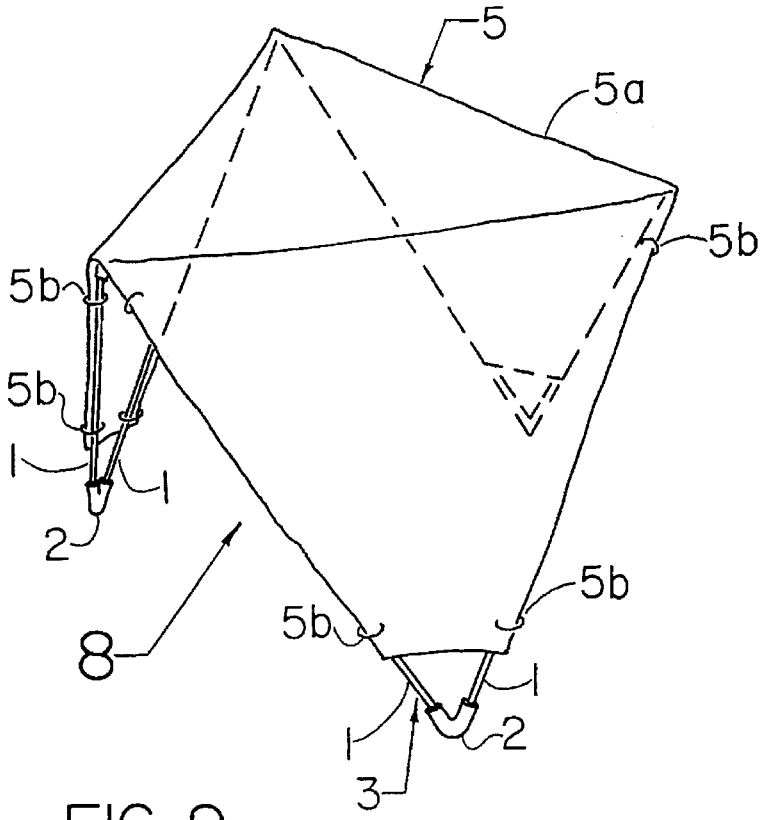
FIG. 9: is a side perspective view of a preferred embodiment of the invention in a stringer-length based "sunshade" configuration.
Figure 10:
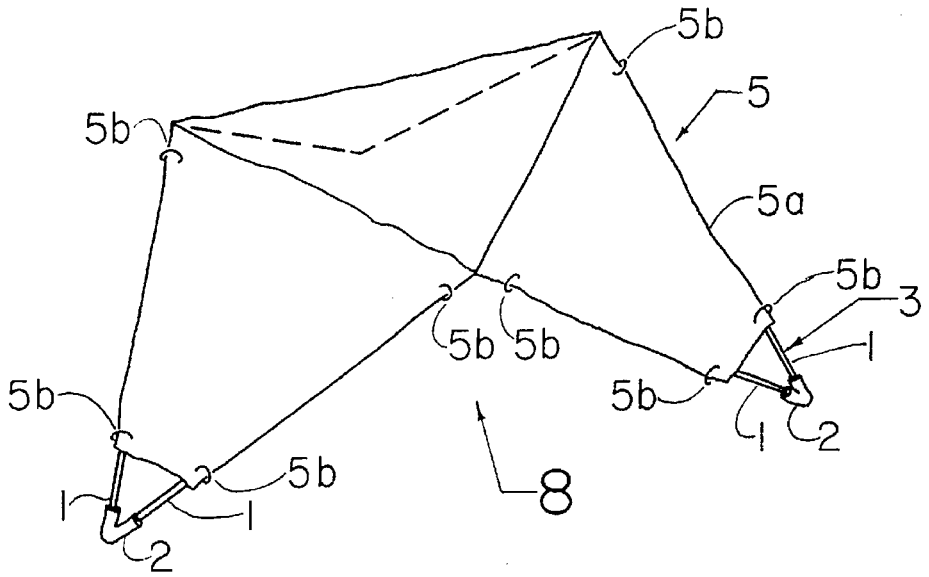
FIG. 10: is a side perspective view of a preferred embodiment of the invention in a wide-based "sunshade" configuration.
Figure 11:
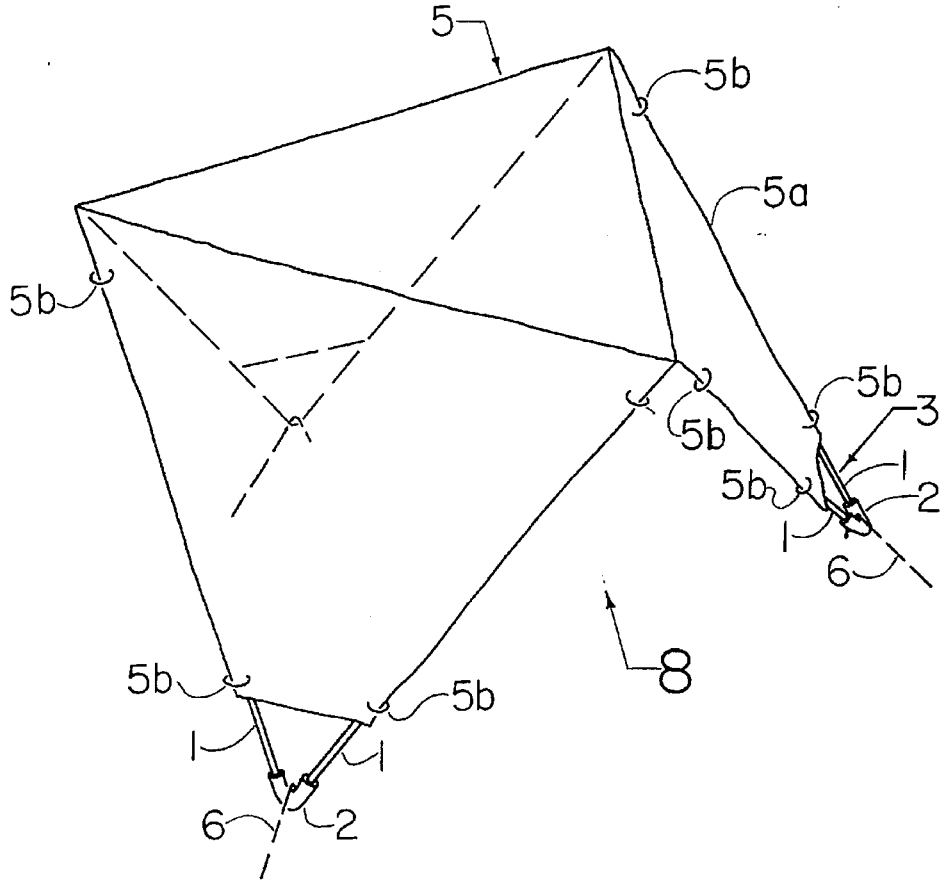
FIG. 11: is a side perspective view of a preferred embodiment of the invention in a wide-based "sunshade" configuration including retaining stakes to maintain the position of the tent configuration.

In order to maintain the position of the tent structure 8, stakes, ties, pins or weights may be used to anchor the points of contact of the structure in a desired position. In a preferred embodiment, rigid stakes or pins 6 as illustrated in FIG. 4 and FIG. 8 may be used to maintain the position of the tent structure 8. Equally useful as a position retaining means, although somewhat less portable are the above noted weights. However, the true versatility of the tent structure 8 is that, for example, on a hiking excursion, readily available rocks can be used in lieu of weights for position retention of the structure. In this way, weights need not necessarily be carried with the present invention, thereby enhancing its portability.

The present invention need not be positioned on the ground. Due to the lightweight and durable construction of the structure, it may be used as a shield or tent by restraining it on a wall, building or other structure.

Figure 4A:
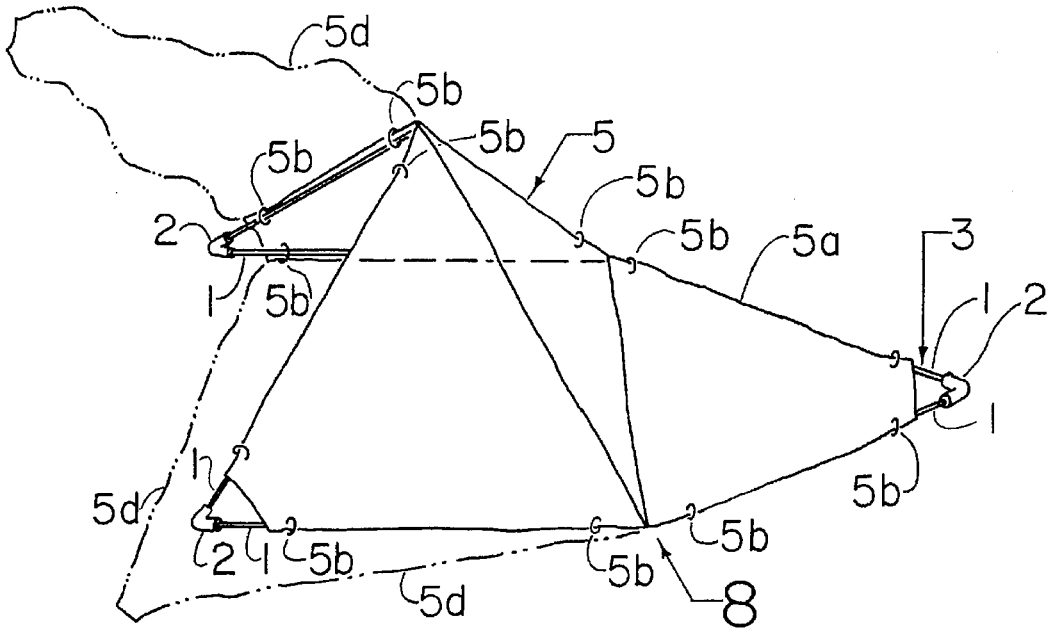
FIG. 4A: is a side perspective view of a preferred embodiment of the invention in a pyramid configuration with an additional flap incorporated into the shaped skin.

While the shaped skin 5 in a preferred embodiment is formed to fully fit the overall geometry of the assembled frame members, the skin may alternatively be formed in a shape to provide additional flaps **5*c*. These flaps 5*c* can be used as side covering or as ground covering as shown in FIG. 4A. Using the shaped skin 5** with additional flaps, the utility of certain tent configurations, such as the pyramid position, is augmented such that an otherwise open position may be enclosed to form a sealed tent or dressing room.

Figure 12:
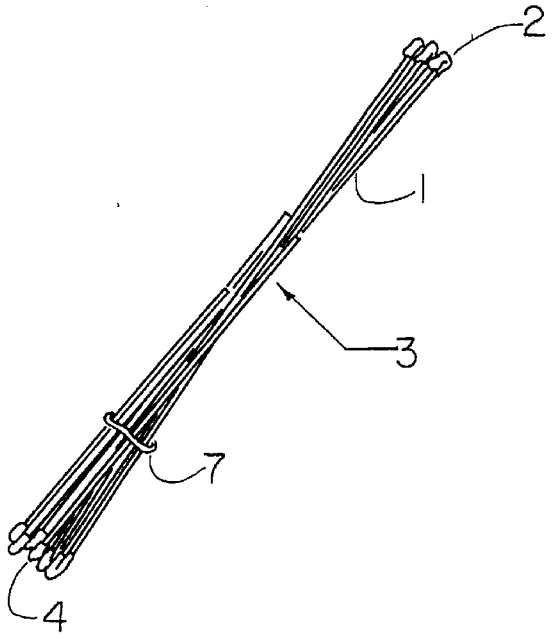
FIG. 12: is an illustration of a preferred embodiment of the disassembled and bundled stringer elements.
Figure 13:
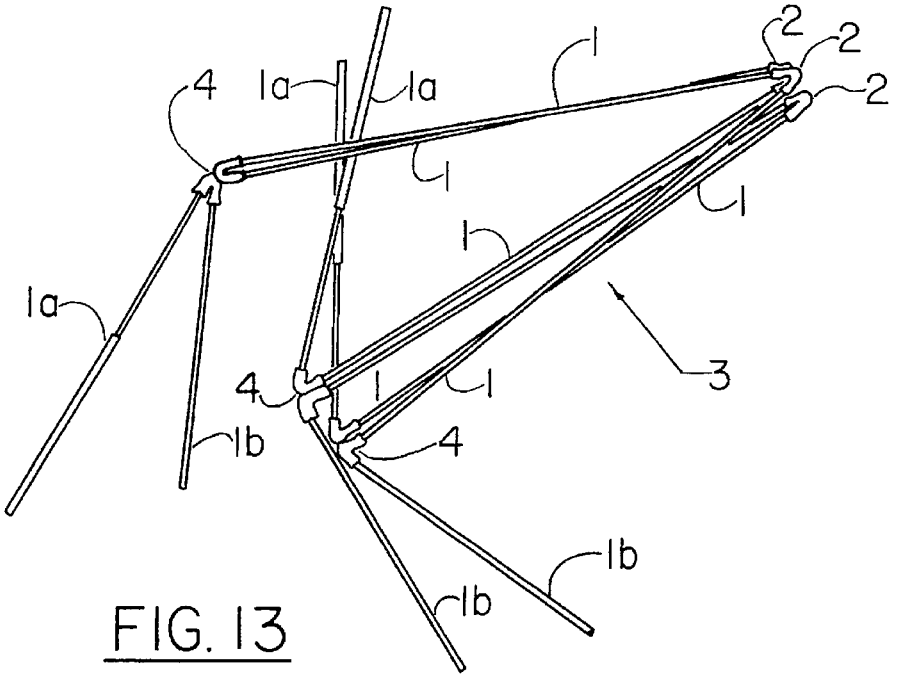
FIGS. 13 through 16: are illustrations of a preferred embodiment of the stringer elements disassembled and unbundled in preparation for assembly.
Figure 14:
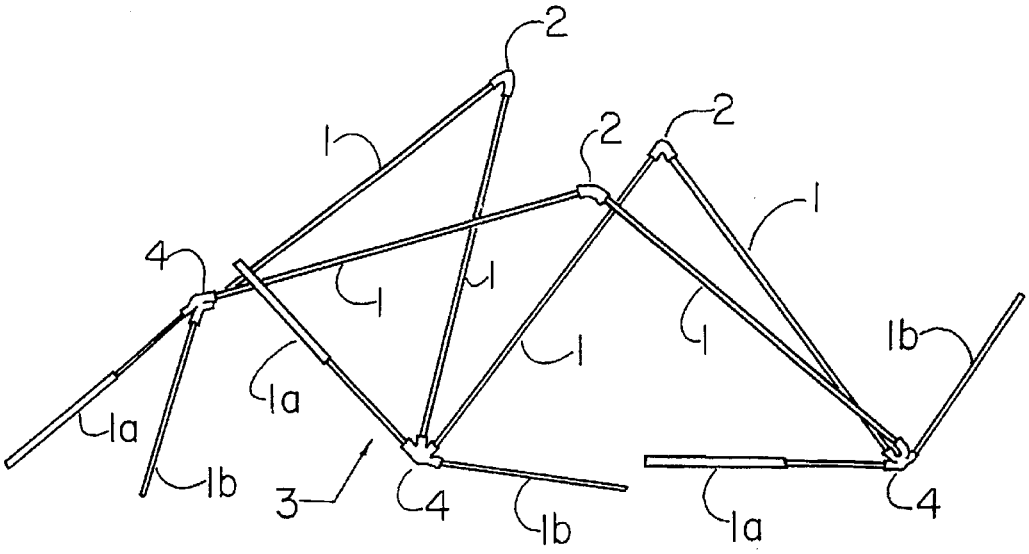
Figure 15:
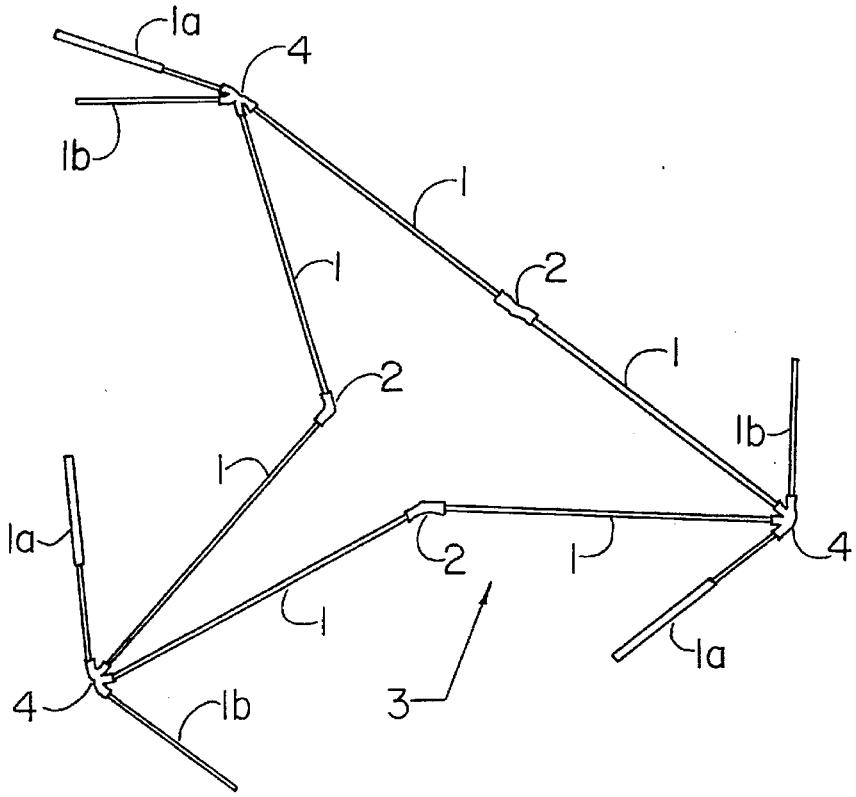
Figure 16:
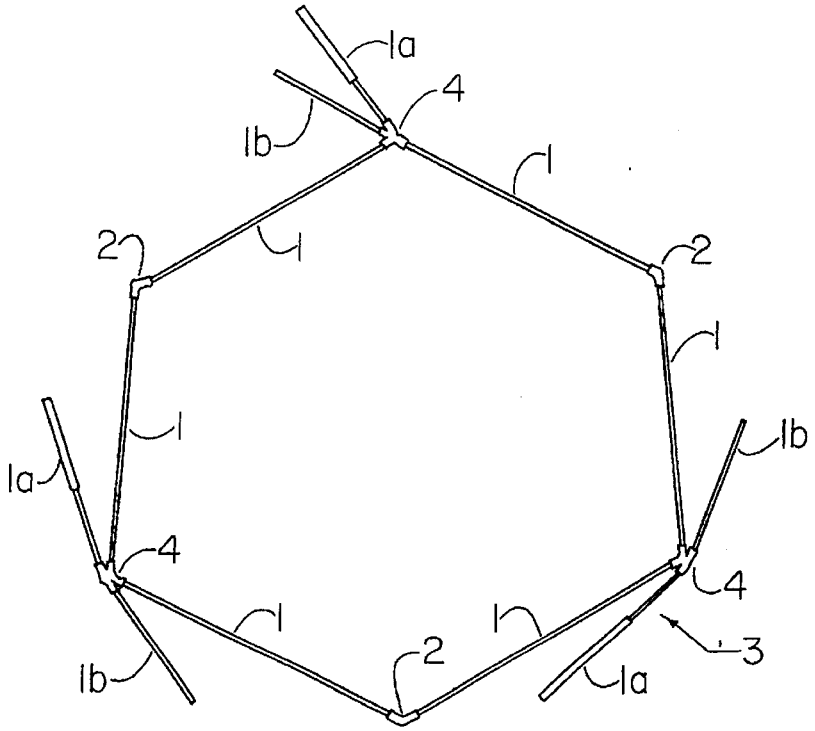
Figure 17:
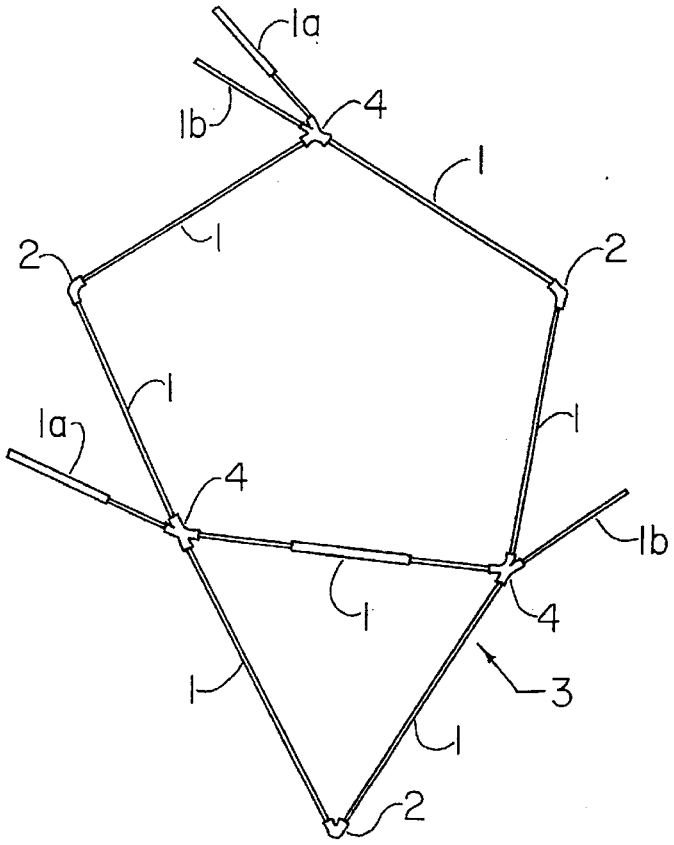
FIG. 17: is a plan view of a preferred embodiment of the stringer elements partially assembled—one stringer interconnection completed.
Figure 18:
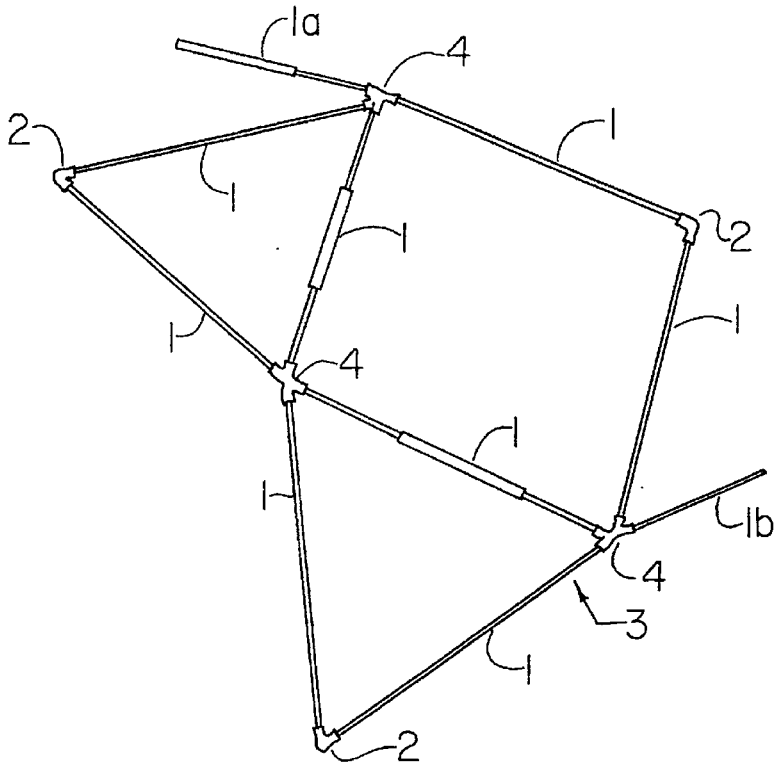
FIG. 18: is a plan view of a preferred embodiment of the stringer elements partially assembled—two stringer interconnections completed.
Figure 19:
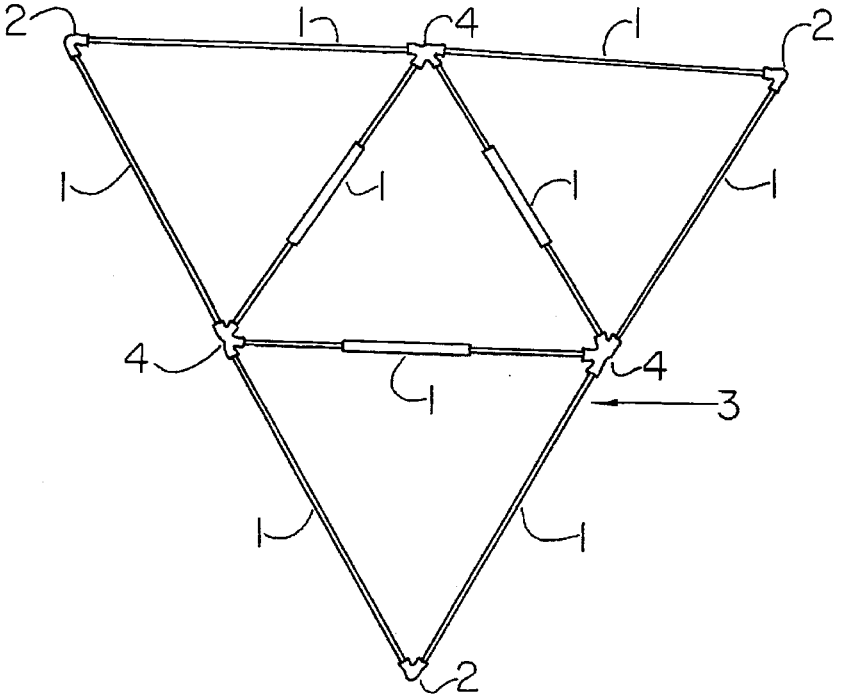
FIG. 19: is a top view of a preferred embodiment of the invention stringers fully assembled without the shaped skin.

As noted, in a preferred embodiment, the present invention is lightweight, portable, collapsible and easily assembled and disassembled. The rigid assembled stringer frame structure 3, shown in FIG. 1, can be disassembled and bundled as one portable unit as illustrated in FIG. 12. However, to enhance portability of the stringer frame structure, the stringer elements 1 may be comprised of two or more subsegments **1*a* and 1*b* joined during assembly to form a full length stringer. FIG. 13 through FIG. 19 illustrate the assembly process of the nine stringer element tent configuration after unbundling of the stringers 1. As shown in these figures, three simple connections of three dual piece stringer elements 1*a* and 1*b* are all that is required to fully assemble the frame structure 3 shown in FIG. 19**.

Alternative embodiments of the stringer assembly, as shown in FIG. 1, could include all nine stringers comprised of two or more joinable subsegments. It has been found that dividing the stringers into more than four subsegments increases assembly complexity and accordingly set up time. As a further configuration alternative, the stringers could be constructed of a plurality of concentric telescoping subsegments similar to camera tripod legs. The telescoping stringer embodiment could alleviate the need to assemble or connect stringer subsegments.

Figure 30:
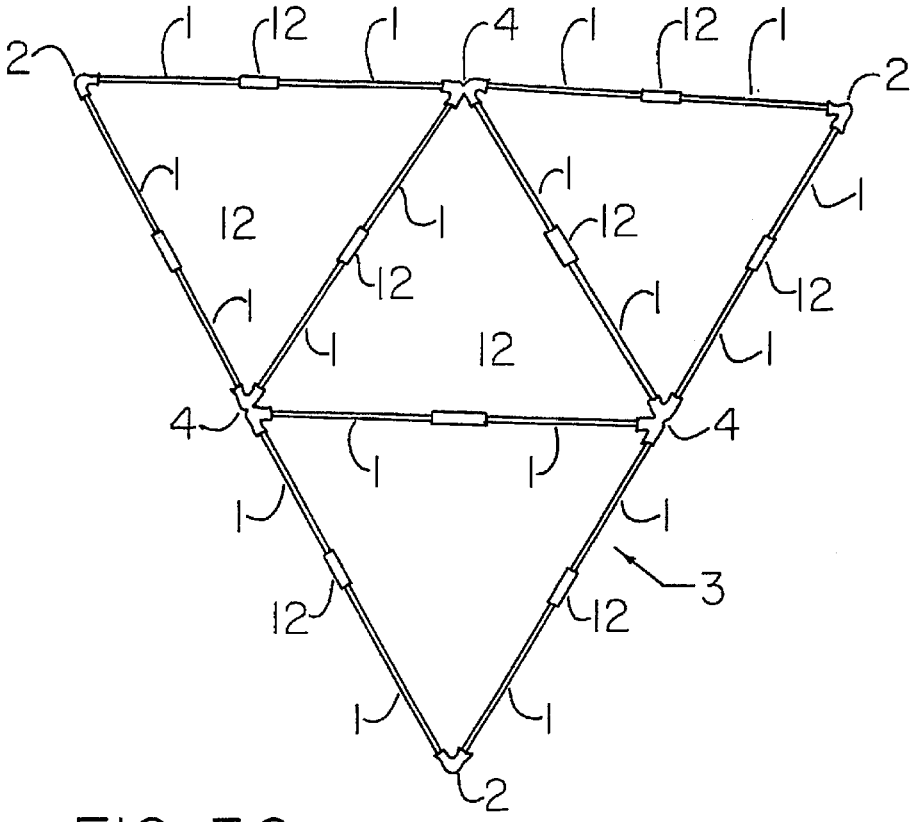
FIG. 30: is a top view of a preferred embodiment of the tent structure frame fully assembled using spring interconnections between stringer subsegments.
Figure 30A:
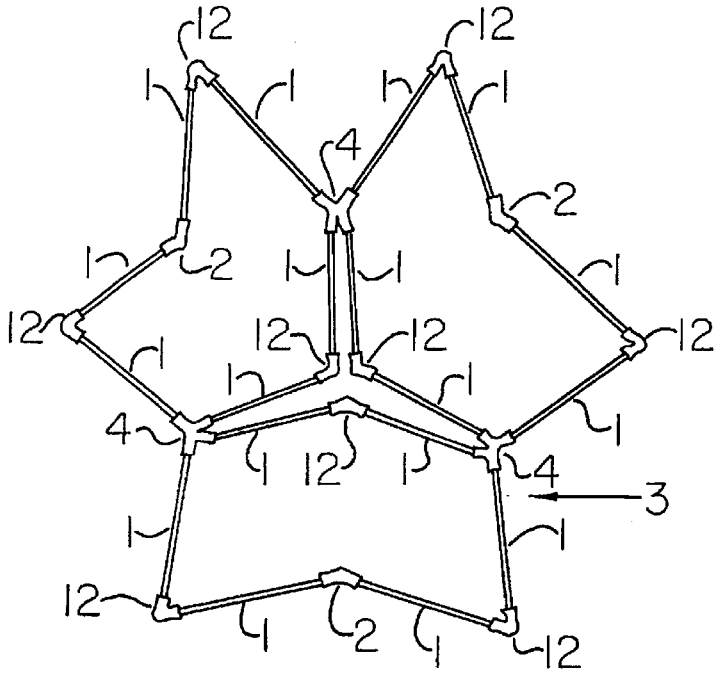
FIG. 30A: is a top view of the FIG. 30 embodiment using spring interconnections between stringer subsegments as it is collapsing into a portable bundle position.

FIG. 30 and FIG. 30A show a stringer embodiment of the tent frame structure with each stringer comprised of two subsegments. In this preferred configuration, the stringer subsegments are interconnected by elastic or spring means. The use of springs 12 to connect the stringer subsegments assists in the assembly of the structure because the spring connection 12 urges the subsegments to achieve an assembled position. As shown in FIG. 30A, the stringer frame structure may be collapsed into one bundle without any disassembly. Similarly, in this preferred embodiment, the bundled frame structure will tend to "assemble" itself due to the spring 12 urging the stringers 1 into the assembled position.

Figure 31:
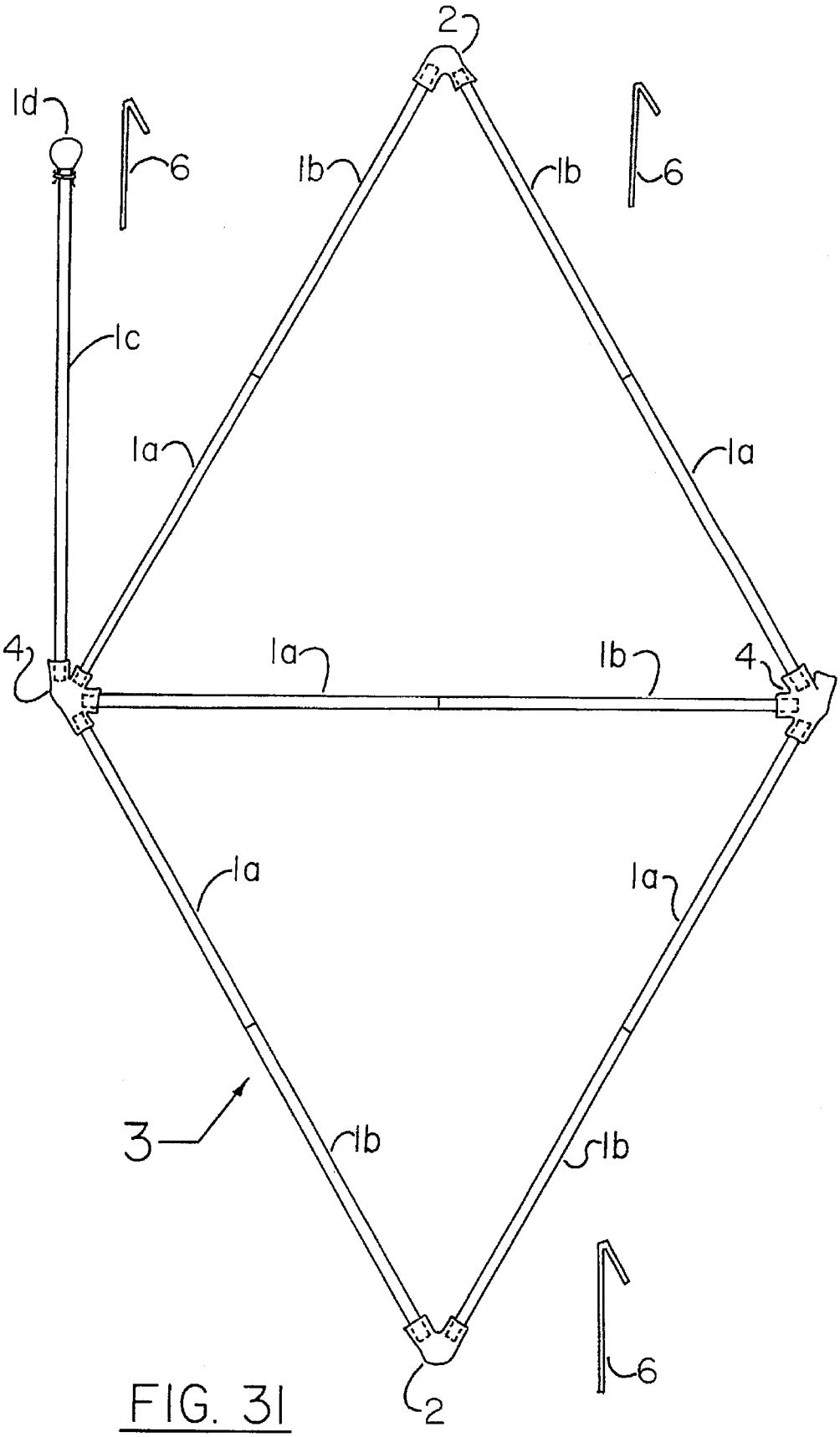
FIG. 31: is a top view of a preferred embodiment of the invention configured from six stringers fully assembled without the shaped skin.
Figure 32:
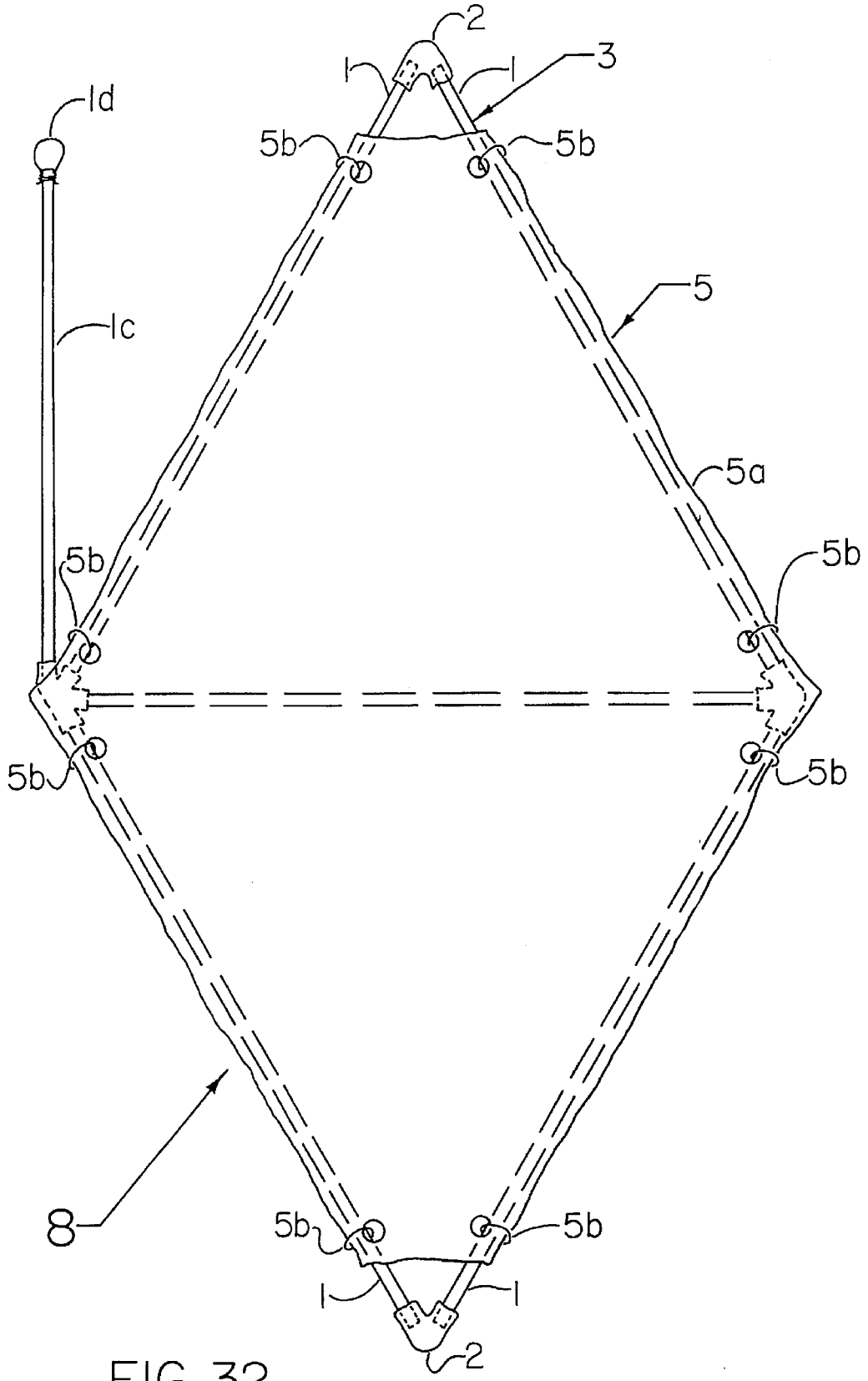
FIG. 32: is a top view of a preferred embodiment of the invention configured from six stringers fully assembled with a full shaped skin attached to the stringers.
Figure 33:
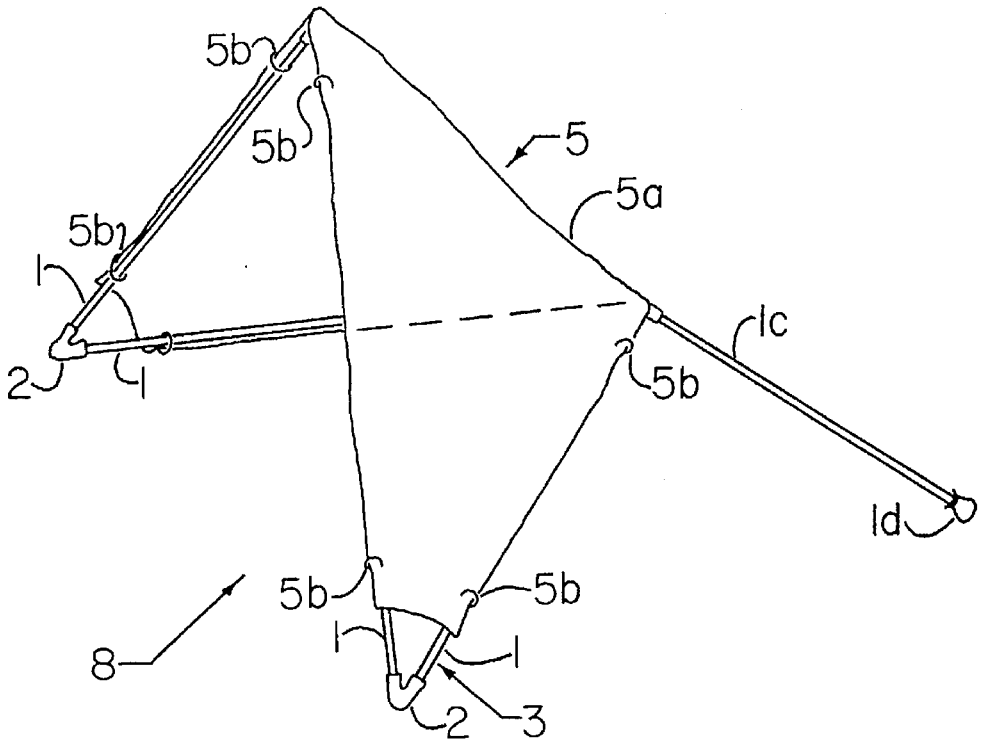
FIG. 33: is a side perspective view of a preferred embodiment of the invention using six stringer elements and configured in a "windblock" configuration.

In addition to the nine stringer element multiple configuration tent structure reconfigurable for different recreational purposes, six stringer elements may also be pivotally interconnected to form two triangular subsegments. In this diamond shaped configuration, as shown in FIG. 31, a separate stringer 1 is available to provide positional or orientation support. Similar to the above described preferred nine stringer embodiment, the diamond shaped six stringer element configuration can be covered with a shaped skin 5 as shown in FIG. 32.

Although the six stringer embodiment is shown configured from equal length stringers 1, in another preferred embodiment, the tent frame structure 8 may be constructed using different length stringers. As applied to the six stringer frame, the resulting structure could be the shape of any four sided configuration in lieu of a diamond shape or parallelogram. In the nine stringer embodiment, different length stringers may be used to create different configurations for sunshades or windblocks.

Figure 34:
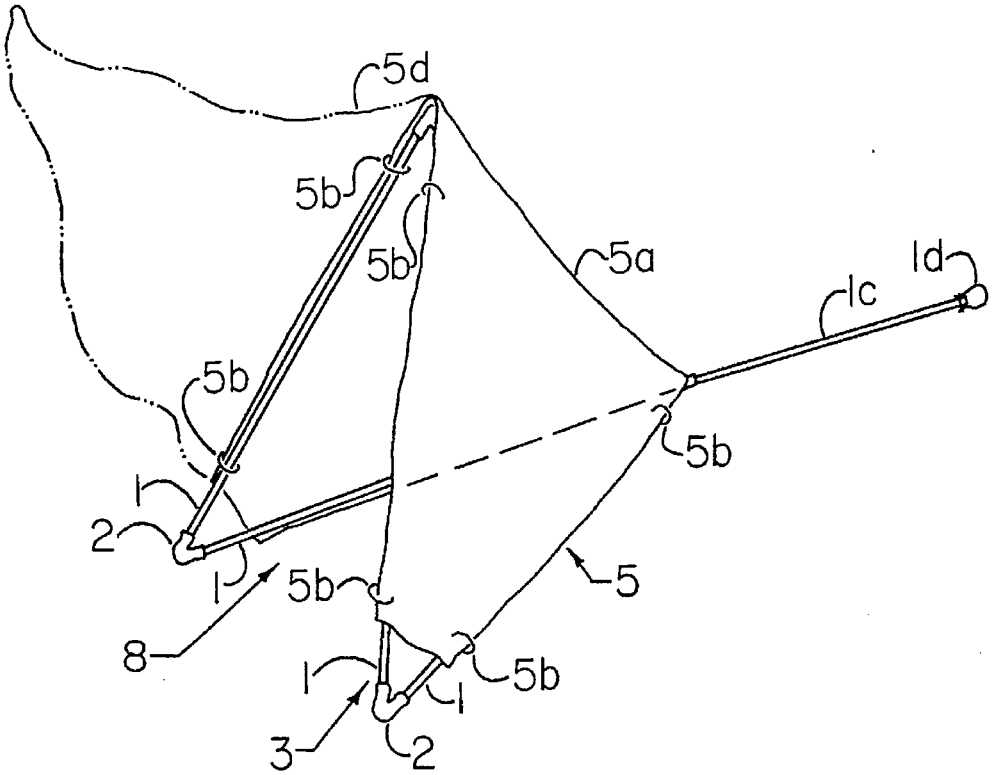
FIG. 34: is a side perspective view of a preferred embodiment of the invention using six stringer elements and having a shaped skin with an additional material for a flap and configured in a potential "dressing room" configuration.
Figure 35:
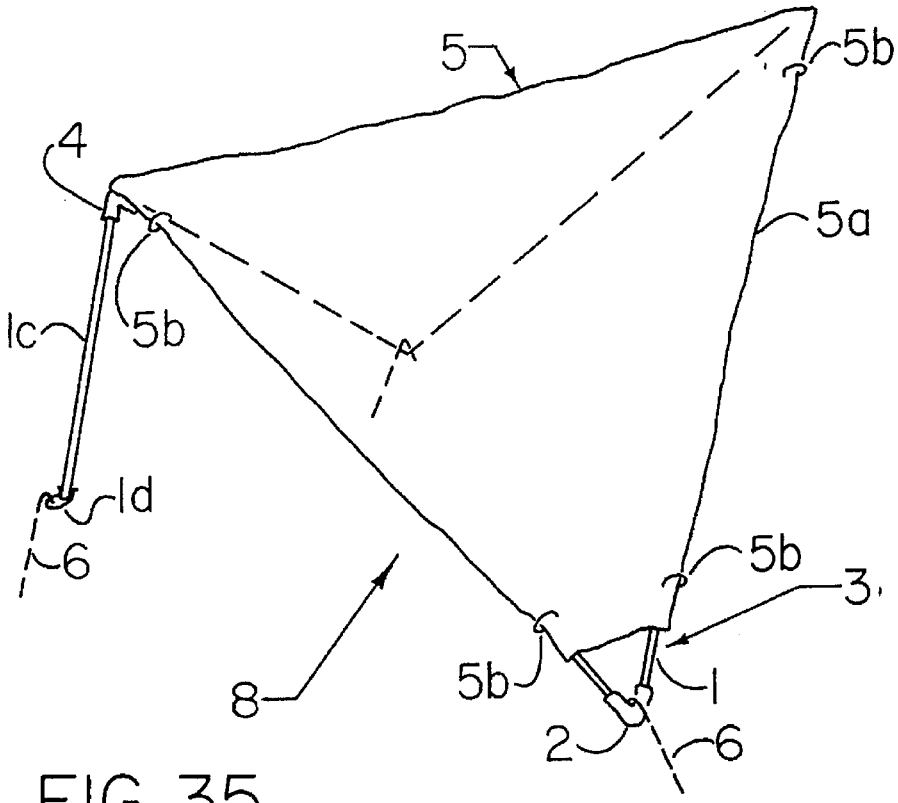
FIG. 35: is a side perspective view of a preferred embodiment of the invention using six interconnected stringer elements and configured in a "sunshade" configuration.
Figure 36:
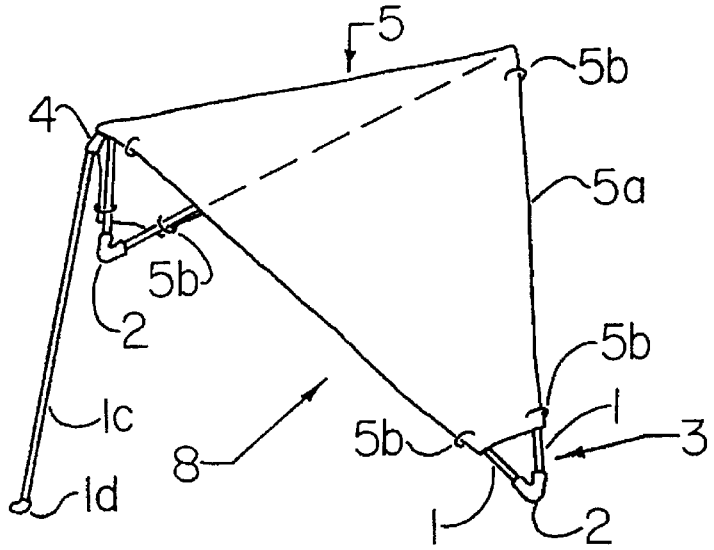
FIG. 36: is a side perspective view of a preferred embodiment of the invention using six interconnected stringer elements and configured in a "sunshade" configuration.
Figure 37:
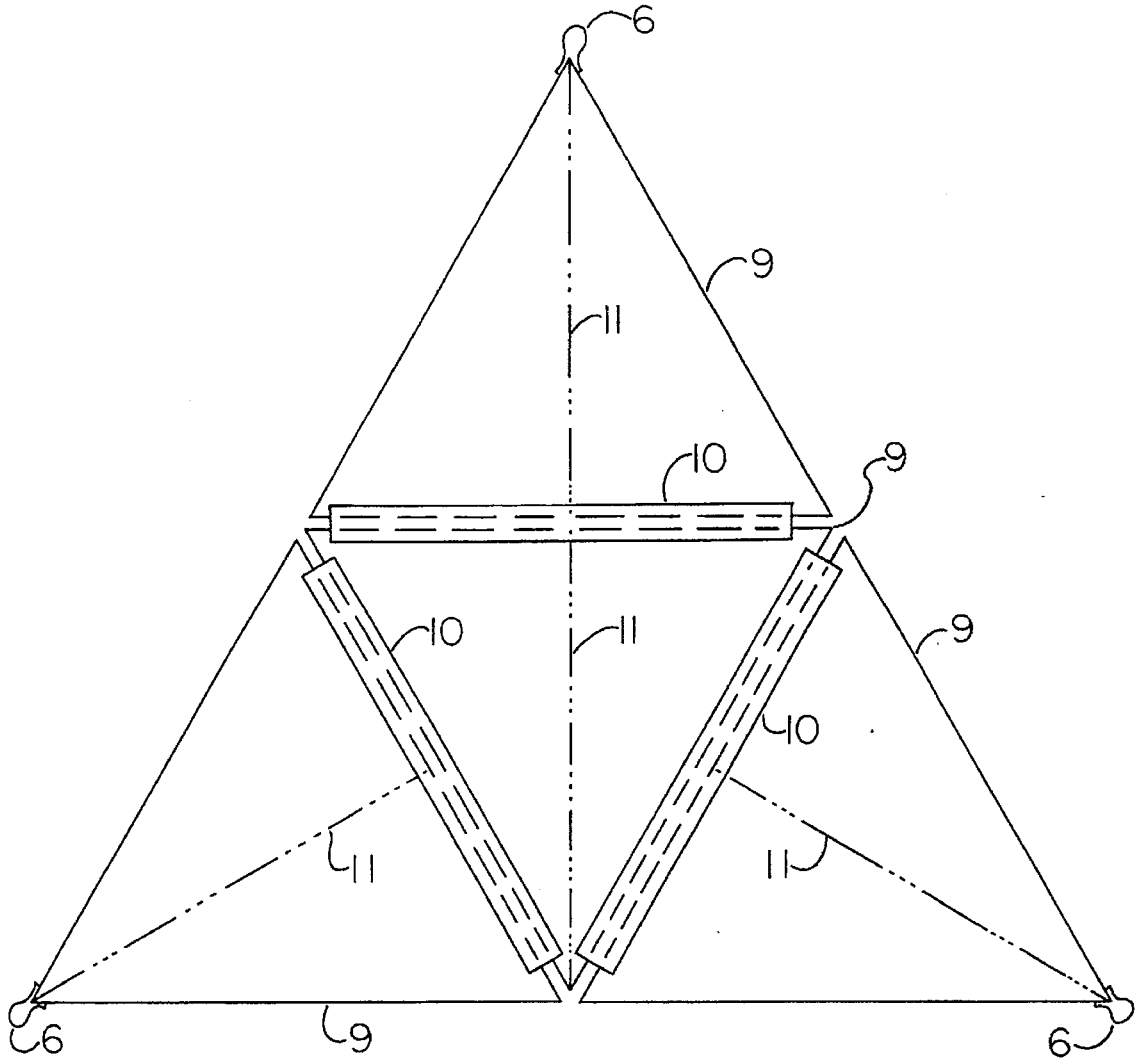
FIG. 37: is a top view of a preferred embodiment of the invention formed from plate elements pivotally interconnected to form the tent structure. The plate elements are pivotal to form a tent of similar configurations to that shown in FIG. 4.

Similar to the nine stringer embodiment, the six stringer embodiment can be configured into a windblock or sun block. Further, with appropriate shaping of the skin to provide additional flap material 5*c*, the six stringer embodiment may be configured into a dressing room as illustrated in FIG. 34. An umbrella or sun-shade configuration for the six stringer element embodiment is shown in FIG. 35 and 36. As shown in these figures, position retaining pins 6 are used to maintain the tent in the desired location.

While the six stringer and nine stringer element configurations have been described and illustrated, a different number of stringer elements 1 may be used to create varied geometric subsegments. These variations, while not shown in attached figures are intended to be within the scope of the described invention and the attached claims.

The above described means for pivotally interconnecting the stringer elements may be constructed from a variety of different materials. Ideally, the pivotal interconnecting means 2 have the same attributes of the overall present invention. That is, the interconnecting means 2 are, among other features, lightweight, durable and aesthetically pleasing.

Figure 20:
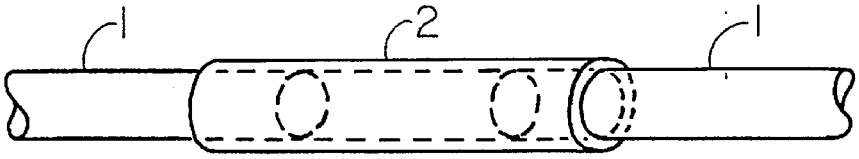
FIG. 20: is a side perspective view of a pivotal stringer interconnection shown in a preferred rubberized tubing embodiment for connecting two stringers.
Figure 21:
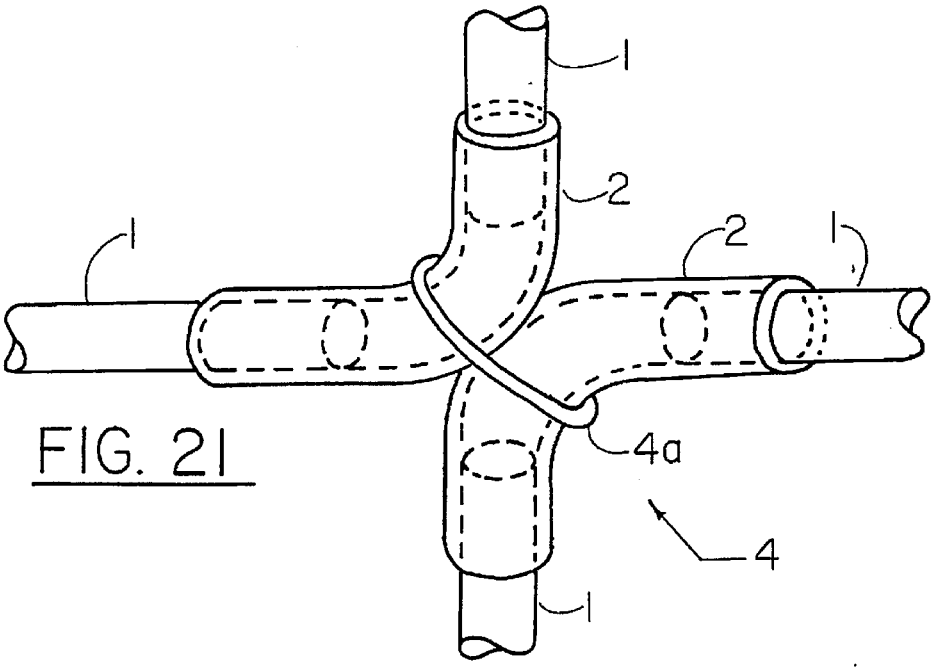
FIG. 21: is a side perspective view of a pivotal stringer interconnection shown in a preferred rubberized tubing embodiment for connecting four stringer ends.

In one preferred embodiment, as shown in FIG. 20 and FIG. 21, rubberized tubing may be used to interconnect the ends of the stringer elements. As shown in these figures, the stringer ends are placed within the rubberized tubing and may be maintained therein by an adhesive (not shown) or by simple friction between the tubing and stringer end. The rubberized tubing provides a smooth and clean fit between the stringers.

Figure 22:
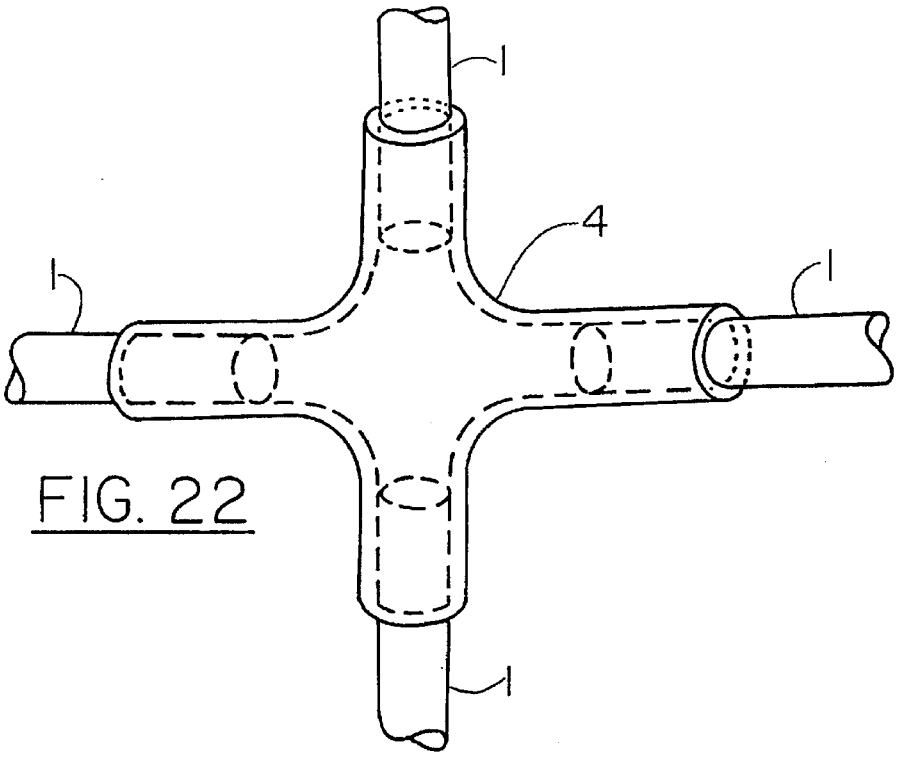
FIG. 22: is a side perspective view of a pivotal stringer interconnection shown in a preferred rubberized tubing embodiment for connecting four stringer ends.

One preferred means of interconnecting four stringer elements 4, as required in the nine stringer embodiment, two separate pieces of tubing may be joined together as shown in FIG. 21. However, an equally functional embodiment of the four stringer interconnection could be a unitized piece of molded rubberized tubing as shown in FIG. 22.

Figure 23:
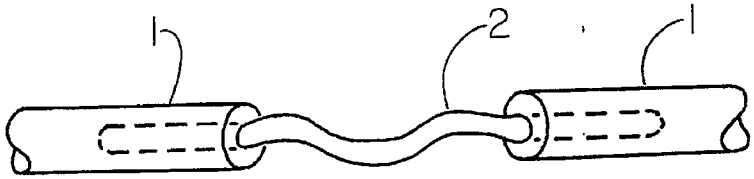
FIG. 23: is a side perspective view of a pivotal interconnection for two stringer elements shown in preferred embodiment of rope or string embedded in the stringer elements.
Figure 24:
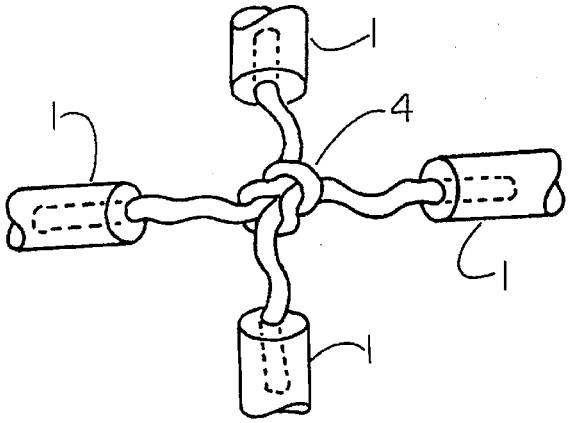
FIG. 24: is a side perspective view of a pivotal interconnection for four stringer elements shown in a preferred embodiment of rope or string embedded within the stringer elements.

An alternative preferred embodiment for interconnecting the stringer elements is accomplished using rope or connectors as shown in FIGS. 23 and 24. In this configuration, the rope or string connectors are embedded within the stringer elements. A feature of the rubberized tubing, as compared to the rope interconnections, is the capability of easy replacement or repair of the pivotal interconnection by simply refitting the stringer elements into new tubing material.

Figure 25:
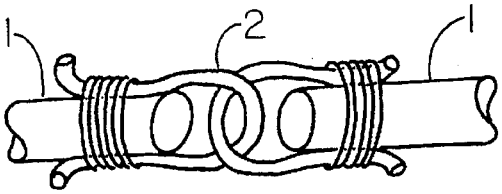
FIG. 25: is a side perspective view of a pivotal interconnection for two stringer elements shown in a preferred embodiment of string loops attached to the stringer ends.
Figure 26:
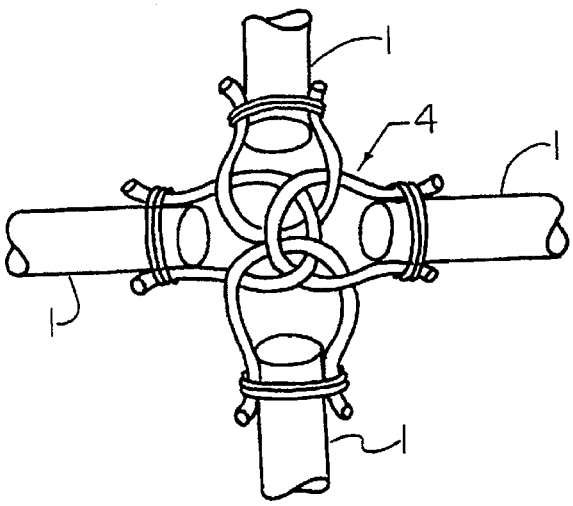
FIG. 26: is a side perspective view of a pivotal interconnection for four stringer elements shown in a preferred embodiment of string loops attached to the stringer ends.

Another preferred embodiment of interconnecting the stringer elements, shown in FIGS. 25 and 26, uses string or rope loops attached to the ends of the stringer elements. The interconnecting loop string elements provide complete flexibility and pivotability of the stringer elements with respect to each other.

Figure 27:
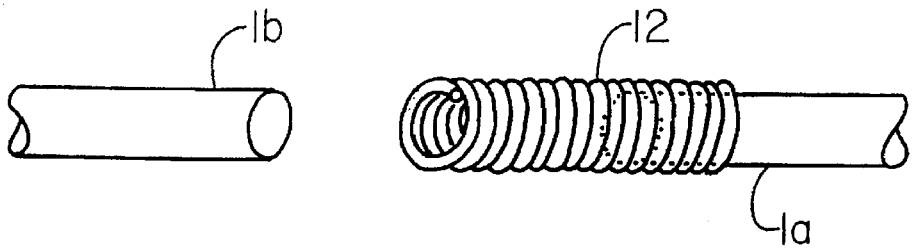
FIG. 27: is a side perspective view of a preferred embodiment spring interconnection between two stringer subsegments.
Figure 28:
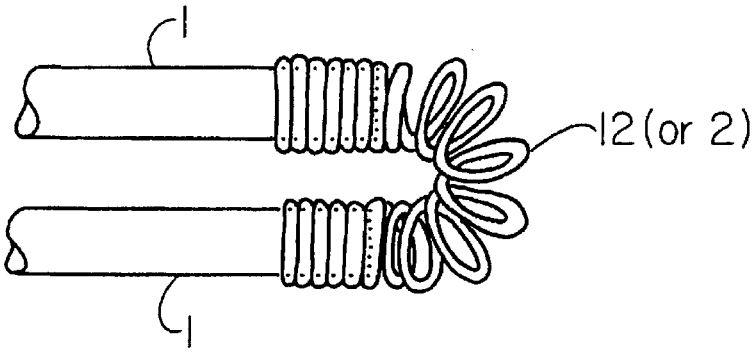
FIG. 28: is a side perspective view of a pivotal interconnection for two stringer elements shown in a preferred embodiment of a spring fitted to each end of the stringers.

In a further preferred embodiment, shown in FIG. 27, flexible spring connectors could be used to attach stringers to each other similar to the above described flexible tubing. A preferred aspect of using springs as the stringers connectors is the tendency for the springs to urge the stringer elements into a set configuration. This is similar to the above described use of springs 12 as connectors between stringer subsegments. Because the springs tend to force the stringers into an aligned position, the unbundled frame structure will essentially unfold into the desired assembled configuration automatically.

Figure 29:
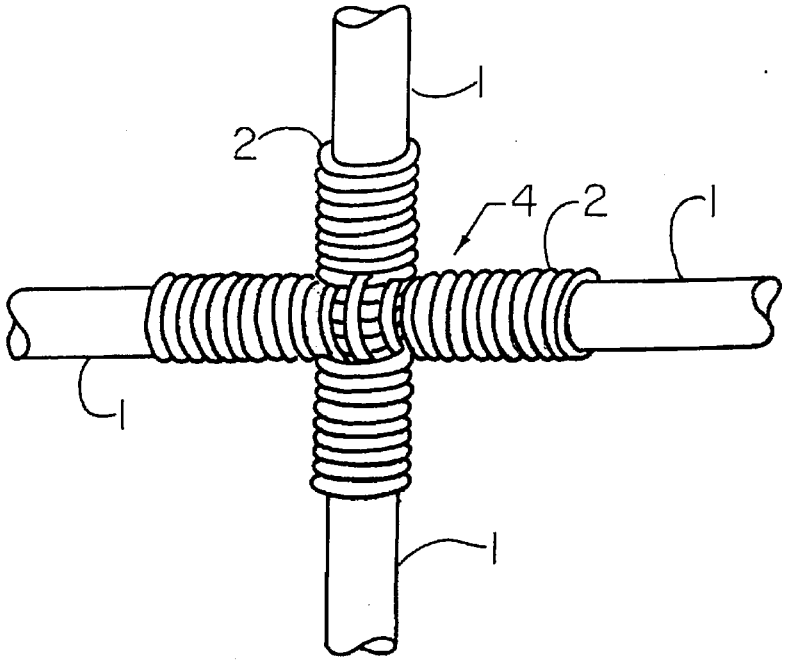
FIG. 29: is a side perspective view of a pivotal interconnection for four stringer elements shown in a preferred embodiment of springs fitted to each end of the stringer.

Finally, FIG. 29 shows the intertwining of two spring connectors to form a four prong connector used to join four stringer ends together.

In another preferred embodiment of the multiple configuration tent structure, interconnected plate segments 9 may be used instead of combining stringer elements 1 and a shaped skin 5. One advantageous aspect of the plate embodiment is that a separate shaped skin 5 is not required. By simply interconnecting the plate segments, a solid protective usable tent structure 8 is created. Moreover, the combination of one or more plates with a plurality of stringers could be used to construct an open sunshade configuration similar to the stringer embodiment with a shaped skin covering less than all of the geometric subsegments.

Interconnection means 10 for the geometric plates can include any of the above described means for connecting the shaped skin to the stringers, for example, Velcro® tape, snap elements, ringlets used in conjunction with a fabric or tape material and grommets embedded into the plates, or any combination of these elements.

In another further preferred embodiment of the geometric plates 9, which provides enhanced portability, the plates are comprised of foldable subsegments. As shown in FIG. 30, in the triangular plate embodiment, fold lines 11 result in each plate being collapsed into half of its unfolded full size.

The several preferred embodiments described for the stringer configuration generally have equal functionality with the plate embodiment. Such variations, including shape of the geometric subsegments and pivot interconnection means are intended to be within the scope of the present invention whether applied to the stringer or plate embodiment.

The above detailed description teaches certain preferred embodiments of the present multiple configuration tent structure 8 invention. While several preferred embodiments have been described and disclosed, it should be recognized by those skilled in the art that modifications to the multiple configuration tent structure 8 may be possible and such modification are within the true scope and spirit of the present invention. Accordingly, it is to be understood that the following claims are intended to cover all of those such modifications.

What claimed is:

1. A multiple configuration tent structure, comprising:

a plurality of pivotally interconnected stringer element which combine to form a plurality of interconnected geometric subsegments, said subsegments, upon complete assembly, able to be configured into different configurations;

a shaped skin to cover at least one of the interconnected geometric subsegments; and means for attaching the shaped skin to the stringer elements thereby forming a contiguous surface over at least one of interconnected geometric subsegments.

2. A multiple configuration tent structure, comprising:

a plurality of stringers pivotally interconnected to form a plurality of triangular subsegments, such that the orientation of the triangular subsegments with respect to each other may be varied;

a shaped skin to cover at least one of the plurality of triangular subsegments and integrally formed to the plurality of stringers defining the subsegments covered by the shaped skin.

3. The multiple configuration tent structure of claim 1, wherein nine stringer elements are pivotally interconnected to form four triangular subsegments.

4. The multiple configuration tent structure of claim 1, wherein five stringer elements are pivotally interconnected to form two triangular subsegments and one stringer element is pivotally connected to the two triangular subsegments to provide the tent structure additional support.

5. The multiple configuration tent structure of claim 3 wherein at least three of the stringer elements are further comprised of a plurality of interconnected subelements.

6. The multiple configuration tent structure of claim 5, wherein the plurality of subelements are foldably interconnected such that the tent structure is collapsible into a unitized bundle.

7. The multiple configuration tent structure of claim 5, wherein the plurality of subelements are elastically interconnected such that the tent structure is collapsible into a unitized bundle.

8. The multiple configuration tent structure of claim 1, wherein at least one of the stringer elements is approximately 10% to 90% the length of the other stringer elements.

9. The multiple configuration tent structure of claim 1, wherein the disassembled stringers are portable within the shaped skin.

10. The multiple configuration tent structure of claim 1, wherein the shaped skin is formed to provide at least one flap.

11. The multiple configuration tent structure of claim 1, further comprising retention means for maintaining the assembled tent structure in a desired location.

12. A multiple configuration tent structure, comprising:

a plurality of stringers;

means for pivotally connecting the stringers to each other to form a plurality of interconnected triangular subsegments, such that the orientation of the triangular subsegments with respect to each other, upon complete assembly, may be varied;

a shaped skin to cover at least one of the plurality of triangular subsegments; and means for attaching the shaped skin to the stringers.

13. The multiple configuration tent structure of claim 12, wherein nine stringer elements are pivotally interconnected to form four triangular subsegments.

14. The multiple configuration tent structure of claim 12, wherein five stringer elements are pivotally interconnected to form two triangular subsegments and one stringer element is pivotally connected to the two triangular subsegments to provide the tent structure additional support.

15. The multiple configuration tent structure of claim 13 wherein at least three of the stringer elements are further comprised of a plurality of interconnected subelements.

16. The multiple configuration tent structure of claim 12, wherein at least one of the stringer elements is approximately 10% to 90% the length of the other stringer elements.

17. The multiple configuration tent structure of claim 12, wherein the disassembled stringers are portable within the shaped skin.

18. The multiple configuration tent structure of claim 12, wherein the pivoting means is rubberized tubing.

19. The multiple configuration tent structure of claim 12, wherein the pivoting means is a spring.

20. The multiple configuration tent structure of claim 12, wherein the pivoting means is a cord material.

21. The multiple configuration tent structure of claim 12, further comprising retention means for maintaining the tent structure in a desired location.

22. A multiple configuration tent structure, comprising:

a plurality of geometric shaped plates; and tape means for flexibly interconnecting the geometric shaped plates, such that upon completion the orientation of each geometric shaped plate with respect to the other plates is variable.

23. The multiple configuration tent structure of claim 22, further comprising a shaped skin attachable to the geometric shaped plates, such that the flexible interconnecting means are covered.

24. The multiple configuration tent structure of claim 22, further comprising retention means for maintaining the tent structure in a desired location.

* * * * *